United States Patent [19]

Boardman

[11] 4,274,351

[45] Jun. 23, 1981

[54] CAN END CLOSURE

[75] Inventor: Alfred H. Boardman, Hamilton, Canada

[73] Assignee: American Can Company, Greenwich, Conn.

[21] Appl. No.: 118,680

[22] Filed: Feb. 5, 1980

Related U.S. Application Data

[62] Division of Ser. No. 55,897, Jul. 9, 1979, Pat. No. 4,213,538.

[51] Int. Cl.[3] ..... B21D 51/46

[52] U.S. Cl. ..... 113/1 F; 113/121 C

[58] Field of Search ..... 113/1 F, 121 C, 121 R; 220/268, 334, 359

[56] References Cited

U.S. PATENT DOCUMENTS

| | | | |
|---|---|---|---|
| 3,886,881 | 6/1975 | Pearce et al. | 113/121 C |
| 3,888,199 | 6/1975 | Herrmann | 113/121 C X |

*Primary Examiner*—Mark Rosenbaum

*Attorney, Agent, or Firm*—Robert P. Auber; George P. Ziehmer; Stuart S. Bowie

[57] ABSTRACT

The instant invention relates to an end closure or cover for a metal container comprising a substantially flat sheet metal lid seamed about its extremity to the container body closing the body end. The lid has a pour opening having a closure hingeably connected to the lid and closing the pour opening provided to retain the closure against inward displacement thereby resisting atmospheric pressure and premature opening of the container and against outward displacement due to internal pressure during processing.

1 Claim, 5 Drawing Figures

CAN END CLOSURE

This is a division of application Ser. No. 055,897 filed July 9, 1979 now U.S. Pat. No. 4,213,538 issued July 22, 1980.

BACKGROUND OF THE INVENTION

The present invention relates generally to end closures for food and drink containers and more particularly to can end closures which have improved scoring in combination with easy opening features which are environmentally acceptable.

There has been a continuing demand for a lid construction for such containers which may be opened without the need of separate opening devices. One such construction generally termed the "pull-tab", embodies a scored outline in the surface of the container lid and a supplemental pull ring attached to an end of the outline to facilitate tearing along the scored outline and lifting it from the can end. That construction has several inherent disadvantages, one relates to the possibility of minor injuries resulting from contact with the edges of the opening or of the discarded pull-tab. A further disadvantage of such construction relates to ecology, and involves the rather prevalent indifference as to the proper disposal of the detached tabs causing complaints of injury and litter and promoting legislation directed at the banning of such container closures. Similarly, the need to add the pull ring is costly and wasteful of material and energy.

Another type of can end construction which has been proposed in recent years is the push-in tab type. An example of can end construction of this type can be found disclosed in U.S. Pat. No. 4,054,228 granted Oct. 18, 1977 and the other prior art therein cited. Those prior patents disclose can opening arrangements which embody can ends having score lines, partial shearing and severing defining two inwardly-displaceable raised tab portions in the can end. The partial shear or severance leaves a residual wall section which is intended to break when the tab portion is depressed. Some prior art shows closures provided with two openings which are closed by slugs stamped from the end panel and are secured to a peelable strip or tape. None disclose an arrangement which is capable of retaining a vacuum and internal pressure.

The prior patent to Balocca et al (U.S. Pat. No. 4,054,228) is singular in its recognition of the problem of using the aforesaid inwardly displaceable tabs with food and drink which are subject to positive and negative pressure during packing and processing. More particularly, a vacuum results where a hermetic seal is required and generates a vacuum pack having atmospheric pressure greater than the internal pressure of the container. The Balocca et al U.S. patent discloses a two sealant means to reinforce and hold the inwardly displaceable tabs against the force of atmospheric pressure. Such an approach was effective to a degree being limited as to the adhesive application consistency and strength of the sealants and the temperature to which the container could be raised during processing. The flexibility sought with respect to the desired vacuum retention by inwardly displaceable tabs is achieved by the present disclosed scoring, shearing and coining of the inwardly displaceable tabs.

It is, therefore, a primary object of the present invention to provide an improved easy open can end closure with scoring and coining of the tabs to eliminate in whole or in part the disadvantages inherent in the can and closures discussed above. More specifically, it is an object of the invention to provide novel forming of the tabs for a can end closure having facile opening features which are ecologically advantageous.

SUMMARY OF THE DISCLOSURE

The instant invention relates to a can end closure comprising a double seamable rim and a central panel having a pour opening and a vent opening each being closed by associated inwardly displaceable tab portions formed from the material of the openings. Each tab is dimensioned and configured to close its opening. Hinge means secure each tab for controlled manually displaceable mounting of the tabs to the end panel. The hinge means is a portion of unworked metal extending between the inwardly displaceable tab portion and the closure center panel from which each tab is formed. The basic elasticity of the metal provides the flexibility about a bending axis for the hinge means. Contiguous with the hinge means are scored curvilinear lines which extend from the hinge axis ends outwardly and in generally opposite directions but curve until substantially parallel to and across from one another. The scored portions are continued and connected by completely severed portions which extend therefrom in a curvilinear fashion on a path which brings them together at a point opposite the hinge. During the forming of the inwardly displaceable tab portions as defined by the scoring and the severed portions a marginal area on each tab opposite the hinge means is coined so as to be enlarged whereby it extends beneath the panel form which it was severed; such extension acting to restrain movement outwardly of the panel.

The scored portion includes a cut to a depth which leaves 0.004 to 0.006 inches of stock remaining. The thickness of the panel is about 0.0125 inches and so the metal which is unsevered and unscored acts as the interconnection to prevent the inward displacement of the tab when subjected to atmospheric pressure from above and less than atmospheric pressure inside the sealed container. The aforesaid interconnection is reliable and can be easily adapted to function with various packing procedures no matter whether the internal pressure is great or small during the processing or subsequent.

DETAILED DESCRIPTION OF THE DRAWINGS

Figure 2:
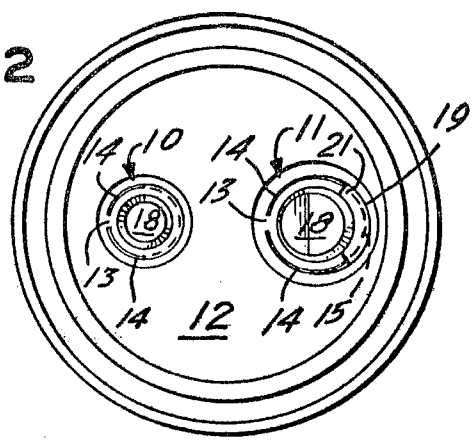
FIG. 2 is a bottom plan view of the end closure of FIG. 1 and the polymeric sealant used to cover and seal the bottom of the inwardly displaceable tab portions has been removed in order to clearly illustrate the present invention.
Figure 1:
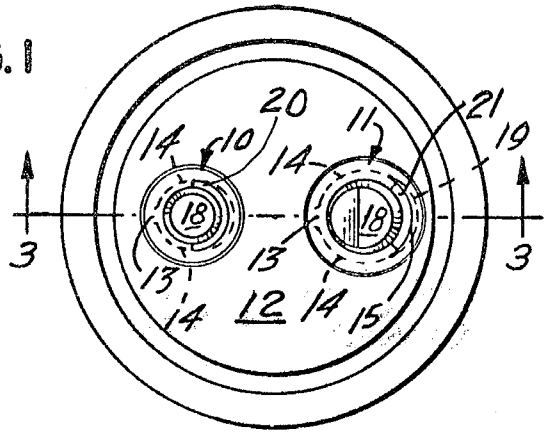
FIG. 1 is a top plan view of the end closure of the present invention showing the inwardly displaceable tab portions as they appear when in their closed or sealed positions.

FIG. 1 depicts the top plan view of an end closure of the type having an inwardly displaceable vent button tab portion 10 and a inwardly displaceable pour opening button tab portion 11 each being circular in shape and protruding upwardly with a hat-shaped cross-section. Each tab portion button 10 or 11 is adapted to be opened inwardly by a preset finger pressure applied from above, and each said button 10 and 11 is designed to be maintained as part of the central panel 12 of the end closure by means of the fabrication method used to produce them. The configuration of each button portion 10 and 11 is similar, whereby similar designations by reference numerals will be used.

Each tab portion 10 and 11 includes a hinge area 13 positioned along a diametric line across the end closure. Said hinge area being approximately 3/32 of an inch along the arcs of the circles which define the overall peripheral shapes of tab portions 10 and 11. The center of the circular portion 10 and 11 are also aligned along the aforesaid diametric line but are spaced apart from one another approximately at an equal distance from the center of the end closure central panel 12. Extending out from the hinge area 13 are several scored arcuate curvilinear sections 14 which penetrate the metal to within 0.004 to 0.006" of completely shearing the metal of the end. More particularly, the end is fabricated from stock which is 0.0125" in thickness such that one-half to three-quarters of the total thickness is severed by the scoring 14. The score line 14 extends from the hinge areas 13 in curvilinear fashion along the arc of the circle generally defining the vent and pour opening button tab portions 10 and 11 approximately half way around the circumference.

The extent (depth) and the length (extension) of the scoring 14 determines the exact resistance to opening of the tab portions 10 and 11. That is to say, that the restraint against opening is a function of the area scored for each button tab portion 10 and 11. However, the material from which the end is fabricated and the sealant also have a bearing upon the resistance to opening. A material which works well in the preferred embodiment of the end is an aluminum alloy designated by the industry as 5182 H19. This material has the requisite flexibility and resilience necessary to be used in connection with the manufacture of the end and its operation.

The configuration of the vent and pour opening buttons being hat-shaped and generally circular include a fully severed area 15 which defines the remaining part of the circular tab portions 10 and 11. The fully severed portion 15 is formed by shearing the peripheral area which extends along the circle forming the remaining arc of about 180° between the end of the scored lines 14 to complete the circle.

Figure 5:
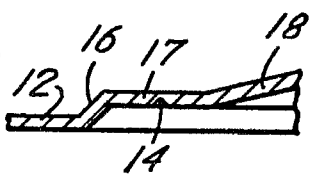
FIG. 5 is an enlarged partial cross-section of the pour opening button tab portion to show the scoring.
Figure 4:
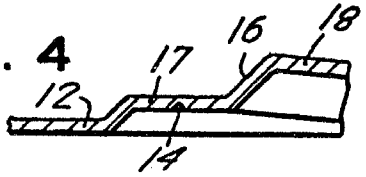
FIG. 4 is an enlarged partial cross-section of the vent button tab portion to show the scoring.
Figure 3:
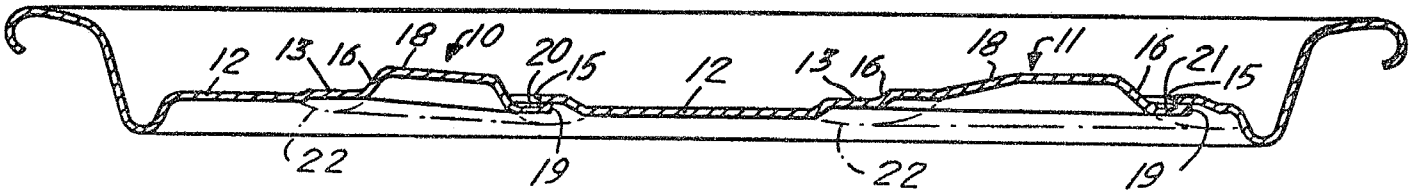
FIG. 3 is an enlarged cross-section as taken along line 3—3 of FIG. 1.

In FIGS. 3, 4 and 5, a part of the hat-shape is shown and includes a generally upwardly extending wall 16 which interconnects an annular rim 17 and a flat top part 18. In generating the inwardly displaceable vent and pour opening tab portions 10 and 11, a progressive forming operation is used to first define the circular hat-shaped configuration of portions 10 and 11. Those skilled in the art will appreciate that the hat-shaped tab portions 10 and 11 can be formed from a basic end having a rim for double seaming and a center panel by means of a conversion press with tooling and dies which stretch and bend the metal during multiple forming operations. Once the metal has been suitably contoured and includes the hat-shaped configurations the end is finished by tooling which partially scores along lines 14 and pierces or severs along lines 15. The tab portions 10 and 11 are not completely formed since the severed parts defined by lines 15 requires further forming in order to make an overlapping section 19, see FIGS. 3, 4 and 5.

More particularly, as best shown in FIG. 1, there is a coined arc 20 on tab portion 10 and a coined arc 21 on tab portion 11. It will be noted that coined arcs 20 and 21 appear as recessed areas of metal in FIG. 1. The force of coining causes the circumference of the tab portions 10 and 11 adjacent to the coining to extend radially outward relative to the center of said portions 10 and 11. It is that extension which provides the overlapping configuration 19, as shown. It will be noted that the amount or length of coined arc 20 or 21 is different for the tab portions 10 and 11 as needed for greater or lesser retention against internal pressure. That is to say that the amount of overlapping 19 necessary is a function of the area of the tab portions which is exposed to internal pressure. The vent button tab portion 10 being smaller in diameter and in overall area requires less overlap 19, than the pour opening button tab portion 11, however, to facilitate tooling arc 20 is longer than arc 21.

In certain applications it is also necessary to reform the hat-shaped section of the tab portions 10 and 11 in order to increase the amount of overlapping 19. This reforming may be done at the same time the coining 20 and 21 is done.

FIG. 3 shows the polymeric compound 22 in phantom which is added to the bottom in order to seal the severed portions along lines 15 of the tab portions 10 and 11. A suitable sealant, such as plastisol, is satisfactory for use in connection with protecting the cut edges and forming air-tight closures along lines 15. The sealant 22 is applied to form the donut-shape which acts to cover not only the severed lines 15 and the overlapping joints 19, but also the rest of the underside of the circumference of the vent and pour opening button tab portions 10 and 11. When manufactured as set forth, the vent button tab portion 10 requires approximately 8 pounds of force to be opened and the pour opening tab portion 11 requires 12 pounds to be opened.

For use, instructions may be embossed on the panel 12 surface of the end adjacent the tab portion 11 indicating that the pour opening must be pushed first. This is contrary to the usual arrangement wherein the vent opening is first pressed on containers having internal pressure such as beer and beverage. More particularly, the vacuum helps to open the larger area tab portion 11 and, therefore, the preferred procedure is specified.

In use, the end as disclosed herein and shown in FIGS. 1 through 5 is double seamed to a container which can be packed with a hot filled or a sceptically packed product and is either retorted or allowed to cool. The extract process will depend upon the nature of the product being packed. Milk products or certain soups and the like require processing which causes the hermetically sealed container to be pressurized during processing and depressurized after cooling. That is to say that, the end as described will have to resist internal pressures of 18 to 20 pounds per square inch during processing by means of the overlapping joint 19 and the polymeric sealant 22 and then during cooling and depressurizing of the contents and the gases in the head space above the contents in the container require less volume whereby the vent and pour opening button tab portions 10 and 11 can be subjected to 15 inches of vacuum. The end as configured, has been tested and found to be capable of resisting as high as 30 inches of vacuum.

Those skilled in the art will appreciate the changes in material in score length and depth and area of overlap can be made which will permit a variety of design parameters to be attained without substantial modification to the overall concept sought to be protected by the claims which follow.

What is claimed is:

1. A method of forming a closure including inwardly displaceable tap portions for venting and pouring including the following steps:

forming a generally circular container end having an outer rim adapted for double seaming to a container and a substantially flat circular central panel with outer and inner surfaces, reforming said central panel to include outwardly displaced hat-shaped sections of circular configuration with one of said sections being larger in diameter than the other;

scoring along approximately one-half of the perimeter of circles defining each of said sections said score extending from an area which remains unscored and unsevered as a hinge;

leaving a residual of unscored material beneath said score and co-extensive thereto for supporting said inwardly displaceable tab portions against undesired opening;

severing the remaining semi-circular circumference of said sections to form a curvilinear cut line between the ends of said scoring away from said hinge;

coining margins of each said severed hat section in order to extend same beneath the adjacent central panel from which same was severed, and sealing the cut edge of said severed inwardly displaceable tab portions with a polymeric material applied to the inner part of said central panel and said margins.

* * * * *